US011926916B2

(12) United States Patent
Behringer et al.

(10) Patent No.: US 11,926,916 B2
(45) Date of Patent: Mar. 12, 2024

(54) COLOR CONTROLLED METAL FINISHING PEN

(71) Applicant: WiSys Technology Foundation, Inc., Madison, WI (US)

(72) Inventors: Brandon Joseph Behringer, Sturtevant, WI (US); Allen E Rocha, Lindenhurst, IL (US)

(73) Assignee: WISYS TECHNOLOGY FOUNDATION, INC., Madison, WI (US)

( * ) Notice: Subject to any disclaimer, the term of this patent is extended or adjusted under 35 U.S.C. 154(b) by 0 days.

(21) Appl. No.: 17/089,951

(22) Filed: Nov. 5, 2020

(65) Prior Publication Data

US 2021/0130972 A1 May 6, 2021

Related U.S. Application Data

(60) Provisional application No. 62/930,962, filed on Nov. 5, 2019.

(51) Int. Cl.

| | |
|---|---|
| ***C25D 11/04*** | (2006.01) |
| ***C25D 11/00*** | (2006.01) |
| ***C25D 11/02*** | (2006.01) |
| ***C25D 11/26*** | (2006.01) |

(52) U.S. Cl.

CPC ..... *C25D 11/022* (2013.01); *C25D 11/005* (2013.01); *C25D 11/04* (2013.01); *C25D 11/26* (2013.01)

(58) Field of Classification Search

None

See application file for complete search history.

(56) References Cited

U.S. PATENT DOCUMENTS

| | | | | |
|---|---|---|---|---|
| 3,466,239 A * | 9/1969 | Hirsch et al. | ..... | C25D 17/14 204/224 R |
| 3,520,792 A * | 7/1970 | Johann | ..... | C25D 17/14 204/224 R |
| 3,939,321 A * | 2/1976 | Bertrand | ..... | B23H 9/001 219/69.15 |
| 4,402,799 A * | 9/1983 | Ash | ..... | H05K 3/241 204/202 |
| 4,840,711 A * | 6/1989 | Joseph | ..... | C25D 5/18 204/DIG. 9 |
| 5,964,990 A * | 10/1999 | Muratori | ..... | C25F 7/00 204/224 M |
| 9,863,056 B2 * | 1/2018 | Chaix | ..... | C25F 7/00 |

(Continued)

FOREIGN PATENT DOCUMENTS

| | | | | |
|---|---|---|---|---|
| DE | 19844832 A1 * | 4/2000 | ..... | B24C 1/086 |
| KR | 100587980 B1 * | 6/2006 | ..... | C25D 11/02 |

OTHER PUBLICATIONS

English Translation CN 102605395, Zhang et al. 2012 (Year: 2012).*

English translation CN 1860260 (Year: 2006).*

*Primary Examiner* — Stefanie S Wittenberg

(74) *Attorney, Agent, or Firm* — Boyle Fredrickson, SC

(57) ABSTRACT

Convenient anodizing is provided through a pen form factor anodizing tool having a reservoir for holding anodizing fluid and an electrical cable connection communicating electrical power to a tip dispensing anodizing fluid from the reservoir at a anodizing voltage from electrical power through the electrical cable connection.

11 Claims, 5 Drawing Sheets

(56) References Cited

U.S. PATENT DOCUMENTS

| | | | | |
|---|---|---|---|---|
| 2005/0106403 | A1* | 5/2005 | Yui | C23C 22/83 427/430.1 |
| 2009/0127103 | A1* | 5/2009 | Sigrist | C25F 7/00 204/196.01 |
| 2014/0224662 | A1* | 8/2014 | Arumugam | C25D 17/00 204/252 |
| 2019/0160568 | A1* | 5/2019 | Sedlacek | C25F 3/02 |

* cited by examiner

COLOR CONTROLLED METAL FINISHING PEN

CROSS REFERENCE TO RELATED APPLICATION

This application claims the benefit of U.S. provisional application 62/930,962 filed Nov. 5, 2019, and hereby incorporated by reference.

STATEMENT REGARDING FEDERALLY SPONSORED RESEARCH OR DEVELOPMENT

Background of the Invention

The present invention relates generally to metal finishing and, in particular, to a pen form-factor anodizing system allowing precise application of different colors during the anodization process.

Anodizing is an electrochemical process that grows an oxide layer on a metal such as zinc, aluminum, titanium, or niobium. While anodizing can provide increased strength and durability, for example, against corrosion or wear, it can also be used to provide a scratch-resistant colored surface to the metal. One method of coloring metal during anodizing applies a dye to the porous anodic film; however, color can also be produced optically by light interference in the transparent anodic layer. In this interference process, different thicknesses of the anodic layer and the competing reflections off the surface of the transparent oxide of the anodic layer and off of the underlying metal surface can produce a range of different colors. The film thickness is generally dependent on the anodizing voltage.

The process normally requires complex equipment and uncommon chemicals putting it out of the reach of the amateur.

SUMMARY OF THE INVENTION

The present invention provides a metal finishing system in a pen form factor having a self-contained chemical reservoir allowing precise local anodizing of metals by inexperienced users. This form factor allows the invention to be used in a wide variety of applications from "touch up" of previously anodized surfaces to large area treatments of previously un-anodized materials.

Specifically, in one embodiment, the invention provides an anodizing pen having a housing extending along a housing axis between a first and second end, the housing sized to be grasped like a pencil by a user with the first end extending distally from the user's hand. The housing holds a reservoir supported by the housing and adapted to hold an anodizing solution. A metering valve is positioned between the reservoir and a metering tip extending from the first end and communicating through the metering valve with the reservoir to receive and release anodizing solution from the metering tip. An electrical cable is received by the housing and provides a conductor in electrical communication with anodizing solution passing through the metering tip.

It is thus a feature of at least one embodiment of the invention to provide a convenient anodizing system in a pen-like form factor.

The anodizing pen may include an electrical control exposed through a wall of the housing to provide control of electrical voltage received on the electrical cable and communicated to the anodizing solution.

It is thus a feature of at least one embodiment of the invention to provide ready access by the user to voltage control such as may be used alter the anodization process, for example, the color of anodized titanium.

The electrical control may provide signals through the electrical cable to a remote power supply to adjust the voltage of that power supply and wherein the electrical cable conducts voltage from the power supply to the anodizing pen.

It is thus a feature of at least one embodiment of the invention to provide a lightweight pen by separating the power supply from the pen while still allowing fingertip voltage control.

The electrical controls may include a first and second button increasing or decreasing the electrical voltage, respectively, by a predetermined increment.

It is thus a feature of at least one embodiment of the invention to provide an intuitive voltage control that does not require taking one's eyes off of the workpiece.

The anodizing pen may further include a normally open electrical switch having an operator exposed through a wall of the housing and positioned between the electrical cable and the anodizing solution to cease providing electrical power from the electrical cable to the anodizing solution when the operator is not activated by the user.

It is thus a feature of at least one embodiment of the invention to deactivate power from the metering tip when the pen is placed aside without conscious effort by the user to turn off the pen.

The normally open electrical switch may include contacts within the housing for disconnecting the electrical cable from the anodizing solution.

It is thus a feature of at least one embodiment of the invention to provide a positive disconnection of the metering tip by local contacts.

The anodizing pen may further include a releasable tip connector at the first end adapted to releasably receive the metering tip and to communicate anodizing solution from the metering valve to the metering tip.

It is thus a feature of at least one embodiment of the invention to permit the user to have different anodizing tools for different effects, like different line widths, etc.

In one embodiment, the metering tip may provide a porous brush having independent multiple filaments conducting anodizing fluid there between.

It is thus a feature of at least one embodiment of the invention to provide a tool suitable for broad area anodization.

In addition or in another embodiment, the metering tip may provide a porous stylus sharpened to a point and conducting anodizing fluid therethrough.

It is thus a feature of at least one embodiment of the invention to provide a narrow dispensation of anodizing fluid, for example, for writing or drawing.

In addition, or in a different embodiment, the metering tip may provide a spring-loaded ball that may be pressed into the metering tip to release anodizing fluid.

It is thus a feature of at least one embodiment of the invention to permit precise flow control depending on whether the tip is pressed against the workpiece or not.

The valve may provide a valve operator extending from the housing to control an opening of the valve and the flow of anodizing fluid from the reservoir.

It is thus a feature of at least one embodiment of the invention to provide fingertip control of anodizing fluid flow rate.

The anodizing pen may further include a power supply receiving the electrical cable to provide electrical voltage to the electrical cable and providing a grounding cable for independent connection to a workpiece.

It is thus a feature of at least one embodiment of the invention to greatly decrease the weight of the anodization pen while providing high current capabilities well adapted to a stationary power supply.

The power supply may be adapted to receive signals from the electrical cable from the anodizing pen to control the voltage provided to the electrical cable.

It is thus a feature of at least one embodiment of the invention to provide fingertip voltage control without the need for complex voltage adjusting circuitry within the pen.

The reservoir may extend from within the housing from the second end and provides a resealable opening through which the reservoir may be filled.

It is thus a feature of at least one embodiment of the invention to provide a refillable reservoir allowing versatile use with a variety of chemistries and without the need for piping or plumbing from a separate reservoir source.

The housing may be constructed of an electrically insulating material.

It is thus a feature of at least one embodiment of the invention to provide two levels of electrical protection including grounding of the workpiece and insulation of the pen.

The housing may provide a radial projection at the second end receiving the electrical cable along an axis substantially parallel to an axis between the first and second end.

It is thus a feature of at least one embodiment of the invention to allow an in-line connection between the reservoir and the pen tip while preserving a parallel cable attachment that promotes flexibility in pen use.

These particular objects and advantages may apply to only some embodiments falling within the claims and thus do not define the scope of the invention.

DETAILED DESCRIPTION OF THE PREFERRED EMBODIMENT

Embodiment One

Figure 1:
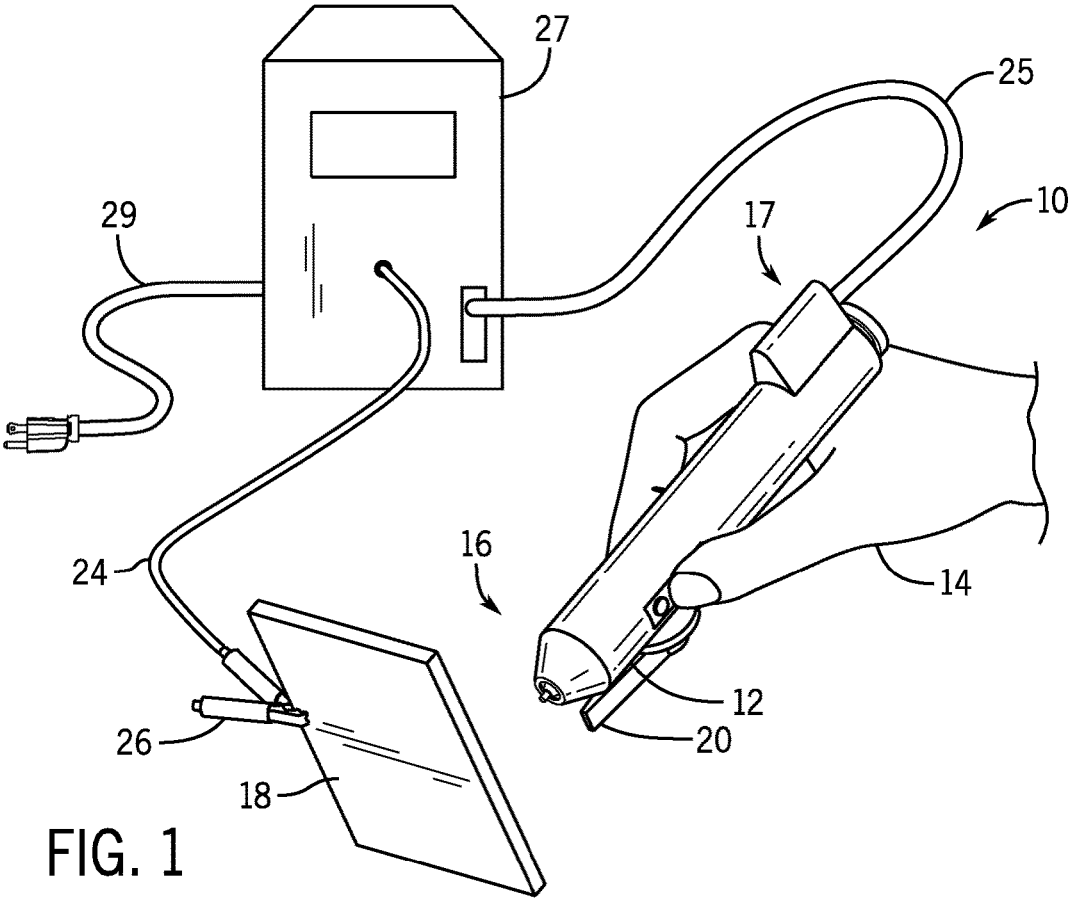
FIG. 1 is a perspective view of a first embodiment of the anodizing pen of the present invention together with the work piece and showing an external power supply.
Figure 2:
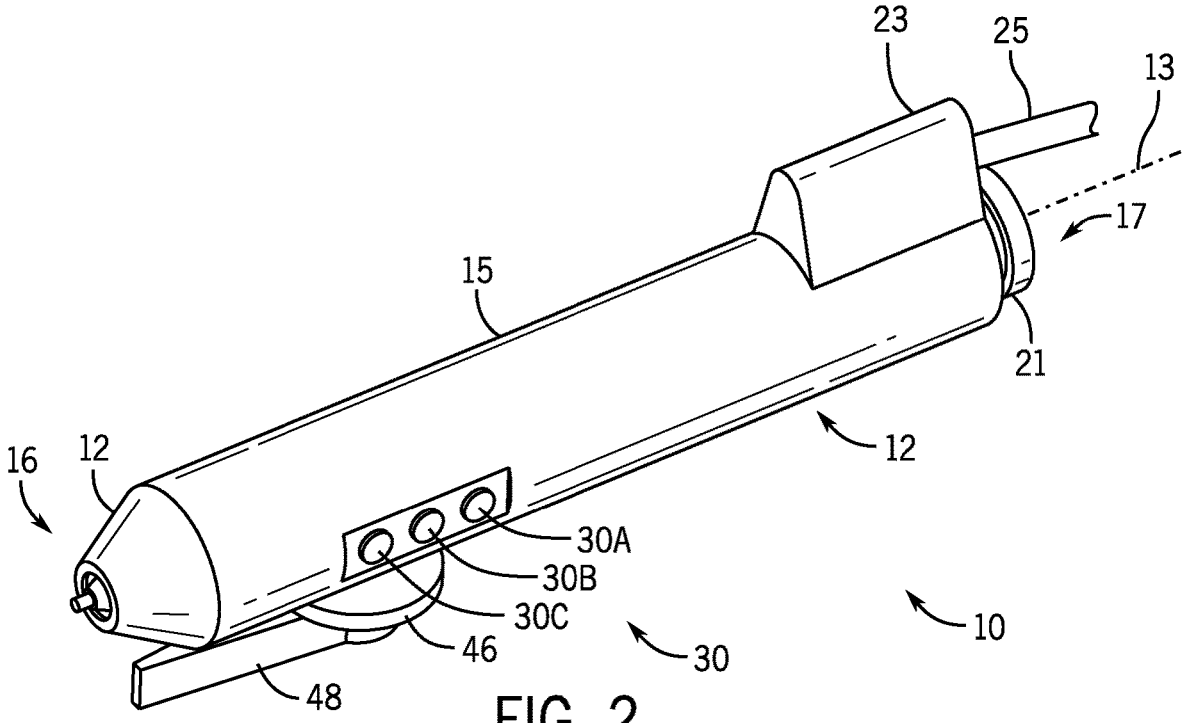
FIG. 2 is a detailed perspective view of the pen of FIG. 1 better showing the controls and valve operator.

Referring now to FIGS. 1 and 2, an anodizing pen 10 of the present invention may provide a generally cylindrical body 12 providing an outer housing 15 constructed of an insulating material such as an injection-molded thermoplastic. Housing 15 includes a main portion extending along an axis 13 that may be grasped by a user's hand 14 in the manner of a thick pen or pencil to position a downwardly extending tip 16 against a metallic workpiece 18 for anodizing the workpiece 18. The tip 16 may be partially surrounded by an insulating collar 20 that separates the user's hand 14 from the anodizing chemicals from the pen 10 as so positioned and electrical voltages as will be discussed below.

An opposite end 17 of the anodizing pen 10, away from the tip 16, may provide for a removable screw thread cap 21 communicating with an internal reservoir (to be described below) to receive anodizing chemicals. A radially extending projection 23 at the rear end 17 receives an electrical cable 25 extending substantially parallel to the axis 13 so that its flexure and weight produce reduced torsional interference with the manipulation of the housing 15 by the user's hand 14. The radially extending projection 23 also displaces the connection with the electrical cable 25 from the cap 21 allowing the reservoir and the removable screw thread cap 21 to be substantially in line with the axis 13 for improved flow control.

The cable 25 may connect with an external power supply 27 delivering a positive voltage to the pen 10 and providing a grounding wire 24 that may clip by means of alligator clip 26 or the like to the workpiece 18 to provide grounding thereof. Generally, the power supply 27 may make use of efficient high amperage transformers and the solid-state switching circuits to control the voltage and current to the pen 10 displacing the weight of the circuitry from the pen 10 and may receive line power through a line cord 29 to eliminate the need for batteries and the like. It will be appreciated that a range of different voltages can be obtained optimized for different treatments and different materials.

Figure 3:
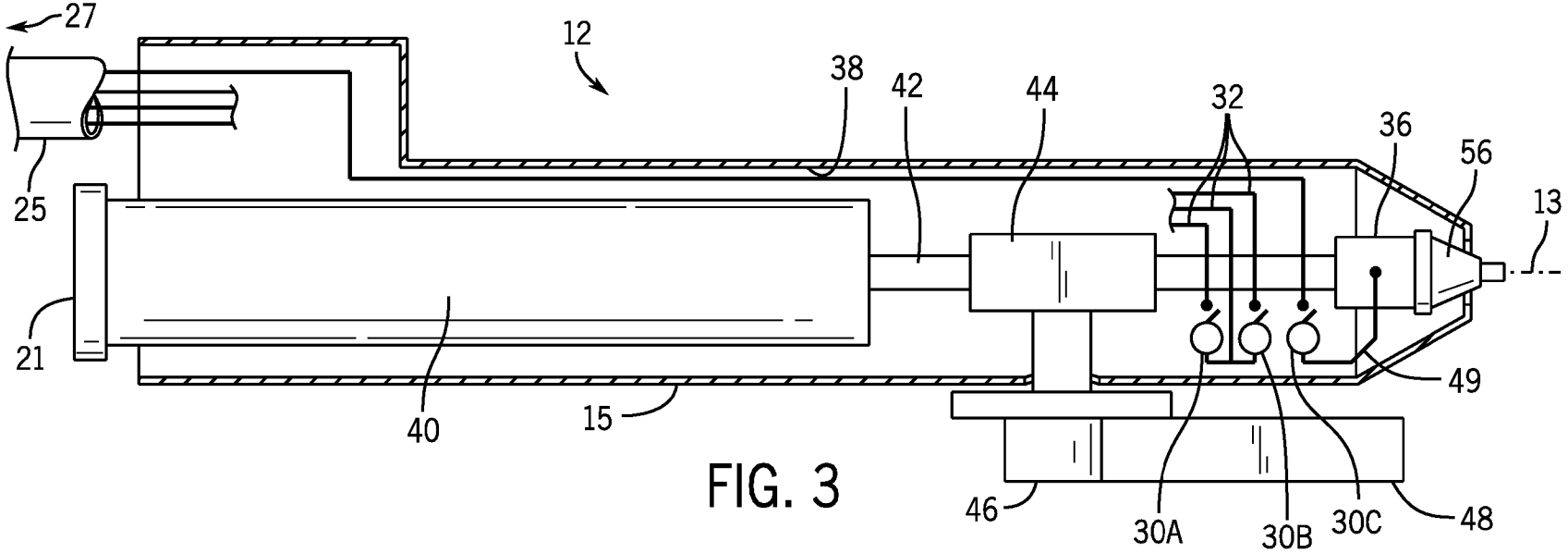
FIG. 3 is a phantom view of the pen of FIG. 1 showing its major components.

Referring now also to FIG. 3, the outside of the housing 15 may expose a set of electrical control buttons 30 for easy access by the user's hand 14 during use of the pen 10. These buttons may include a first button 30*a* marked with a "+" and a second button 30*b* marked with a "−" that serve to control the anodizing voltage by increasing it or decreasing it, respectively, in regular increments, for example, by 1 V or 5 V or 10 V as may be desired between limits of approximately 10 V and 100 V. It will be appreciated that each of the first button 30*a* and second button 30*b* may communicate with electrical contacts that in turn communicate signals through conductors 32 of the cable 25 with the power supply 27 to provide signals to the power supply 27 to make the necessary voltage adjustments, for example, by controlling solid-state switching circuitry or the like.

The control buttons 30 may also include a safety button 30*c* that is normally off, and that is associated with normally open contacts within the housing 15 positioned between a conductive tip socket 36 and a power line 38 of the cable 25, the latter being connected to the source of anodizing voltage from the power supply 27. This button 30*c* must be continuously activated for electrical power to be applied to the tip socket 36 and thus provides automatic shutdown of the pen 10 when it is not being held by the user.

A reservoir 40 extending along axis 13 within the housing 15 holds anodizing liquids received through screw thread cap 21 to be conducted by a conduit 42 to a valve 44. The valve 44 includes an external operator lever 46 extending from the housing 15 that can be readily controlled by the user's fingers during use of the pen 10. In this regard the lever 46 has a forwardly extending paddle 48 terminating near the tip 16. Rotation of the operator lever 46 controls the flow of anodizing liquid from the reservoir 40 to the tip socket 36.

The reservoir 40 may be constructed of a chemically inert material such as a thermoplastic, like polypropylene, to be compatible with a wide variety of different anodizing solutions including solutions for titanium and aluminum which may include acids such as sulfuric acid or chromic acid. The invention contemplates that the screw thread cap 21 may include a tubing connector for receiving a continuous supply of anodizing solution from an external reservoir and pump, for example, for use of the present invention for anodizing larger applications.

Figure 4:
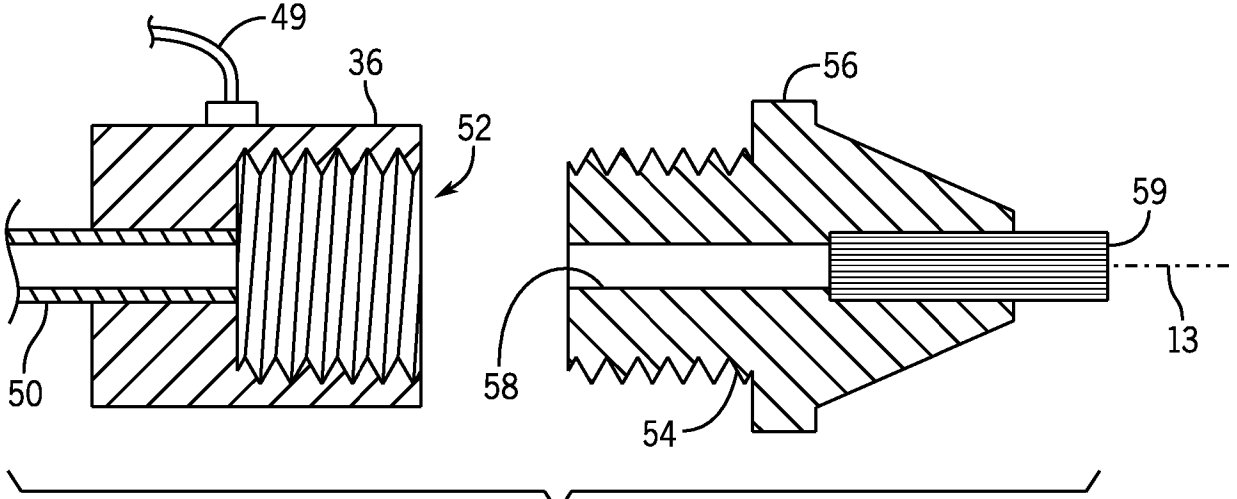
FIG. 4 is a exploded cross-sectional view of the tip and tip socket allowing for replaceable tip elements.

Referring now to FIG. 4, the tip socket 36 may be a conductive material receiving electrical power through lead 49 passing from the switch of button 30*c* to electrically communicate with anodizing fluid received from conduit 50 passing from valve 44. The tip socket 36 provides a threaded bore 52 that can receive corresponding threads 54 of a replaceable tip element 56. Generally, the tip element 56 provides a coaxial channel 58 leading to a dispensing element 59 that can conduct anodizing fluid from the conduit 58 to the workpiece 18 in a controlled manner.

Figure 5A:
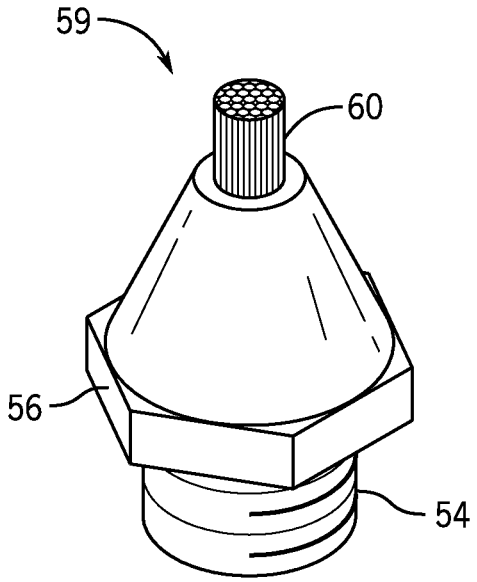
FIGS. 5*a*-5*c* are perspective views of different tips of FIG. 4 with FIG. 5*c* showing internal channels in phantom.

Referring now to FIG. 5, in one embodiment the tip element 56 may provide for a set of flexible bristles 60 extending forwardly along the axis 13 to conduct anodizing fluid between the bristles 60 in the manner of a paintbrush by capillary flow or the like allowing smooth application of anodizing fluid to the workpiece 18 at the desired electrical potential.

Figure 5B:
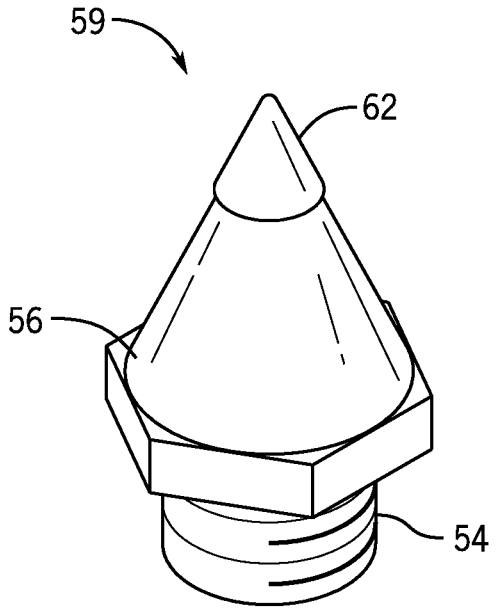

Alternatively, as shown in FIG. 5*b*, the tip element 56 may provide for a sharpened felt tip 62 in the matter of an ink marker or the like having internal porosity to conduct anodizing fluid to a sharpened tip for accurate deposition of that fluid in a local region on the workpiece 18.

Figure 5C:
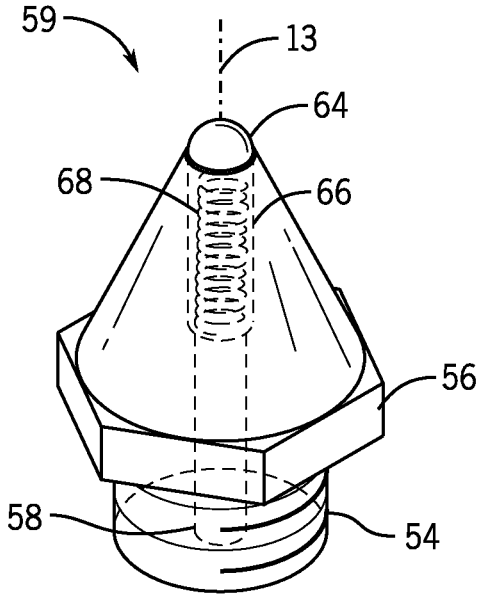

As shown in FIG. 5*c*, in an alternative embodiment, the tip element 56 may provide for a spring-loaded ball 64 held captive against release from the tip of the tip element 56 by a constriction at the top of an internal axial bore 66. The axial bore 66 holds a helical compression spring 68 pressing the ball 64 upward against its constricted seat and thus blocking the internal bore and the channel 58 to which it connects and preventing the outflow of anodizing fluid. Pressing of the tip element 56 against the workpiece 18 pushes the ball 64 inwardly providing a metered release of anodizing fluid.

It will be appreciated that the pen 10 may be used with a variety of different anodizing chemicals well known in the art and that the size of the tips and their materials may be freely varied to be compatible with different chemicals and tasks. In addition, when the pen 10 is used in an automated environment, each of the tips 56 may be mounted on a turret (not shown) that may be rotated, for example, by an electrical actuator to bring different tips 56 into connection with the tip socket 36 so that a variety of different tips 56 may be used on a given workpiece at different times. A similar arrangement may be used in a nonautomated environment by manual rotation of the turret.

Embodiment Two

Figure 6:
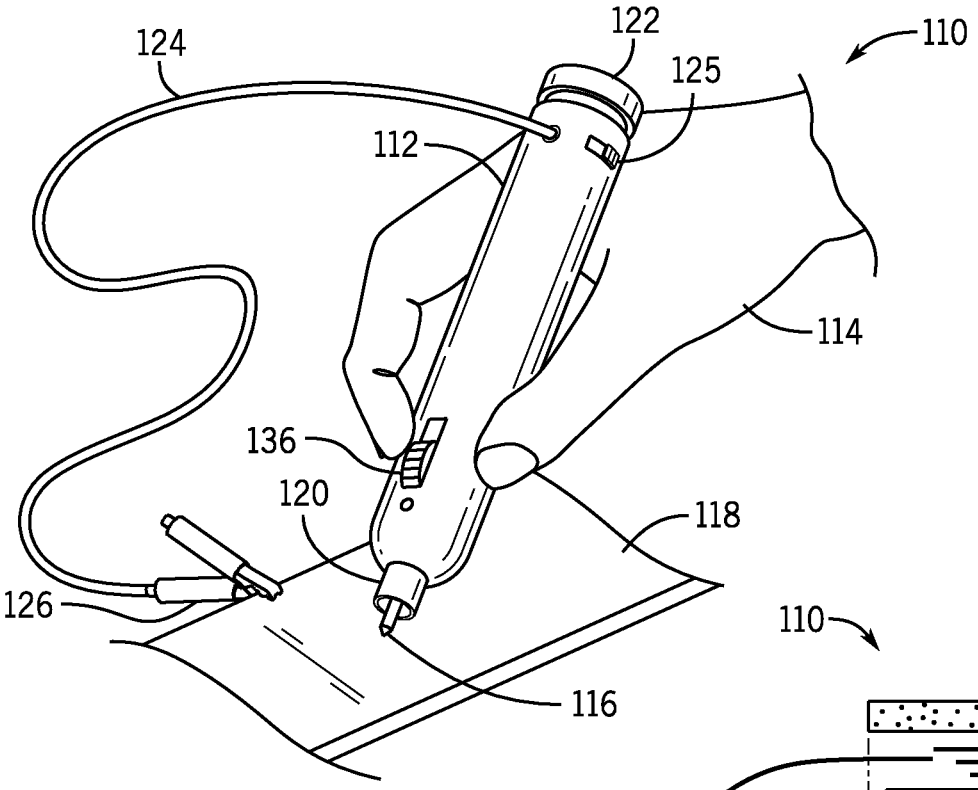
FIG. 6 is a perspective view of a second embodiment of the pen system of the present invention as used by an individual for local application of anodizing colors.

Referring now to FIG. 6, an anodizing pen 110 according to a second embodiment of the present invention may also provide a generally cylindrical body 112 that may be grasped by a user's hand 114 in the manner of a thick pen or pencil to position a downwardly extending tip 116 against the metallic workpiece 118 for anodizing the workpiece 118. The tip 116 may be partially surrounded by a collar 120 that assists in the delivery of anodizing chemicals from the pen 110 as so positioned and as will be discussed below.

An opposite end of the anodizing pen 110, away from the tip 116, may provide for an "eraser" 122 intuitively positioned in the manner of a conventional pencil eraser. This eraser 122 is a mild abrasive that may be used to prepare the surface of the workpiece 118 to be anodized by removing oxide, dirt, and the like. In one embodiment the eraser 122 backspace may be, for example, a sponge abrasive of a type commercially available from the Procter & Gamble Company under the tradename of "Magic Eraser" composed generally of a melamine (formaldehyde-melamine-sodium bisulfate copolymer) foam.

A grounding wire 124 may extend from the cylindrical body 112 at a point away from the tip 116 to be free from interference with the user's hand 114 during use. This grounding wire 124 may in turn attach to an alligator clip 126 or the like which may connect to and provide a ground connection to the metallic workpiece 118. An electrical on-off switch 125 may also be positioned at this end of the cylindrical body 112 for ready access by the individual but outside of the normal areas where the pen 110 will be grasped.

Figure 7:
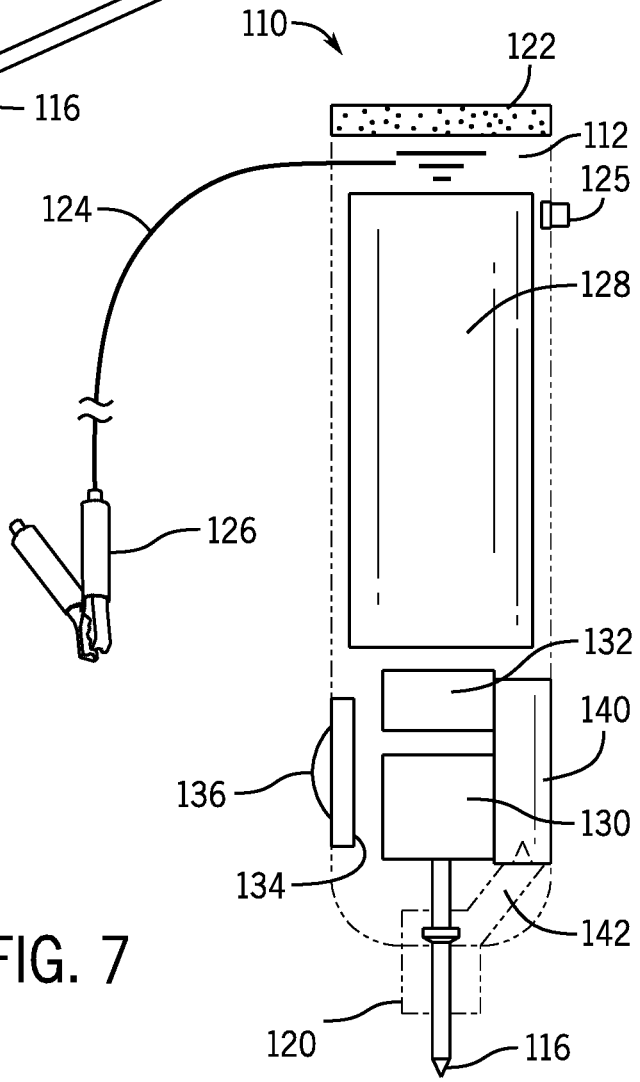
FIG. 7 is a phantom view of the pen of FIG. 6 showing its major components.
Figure 8:
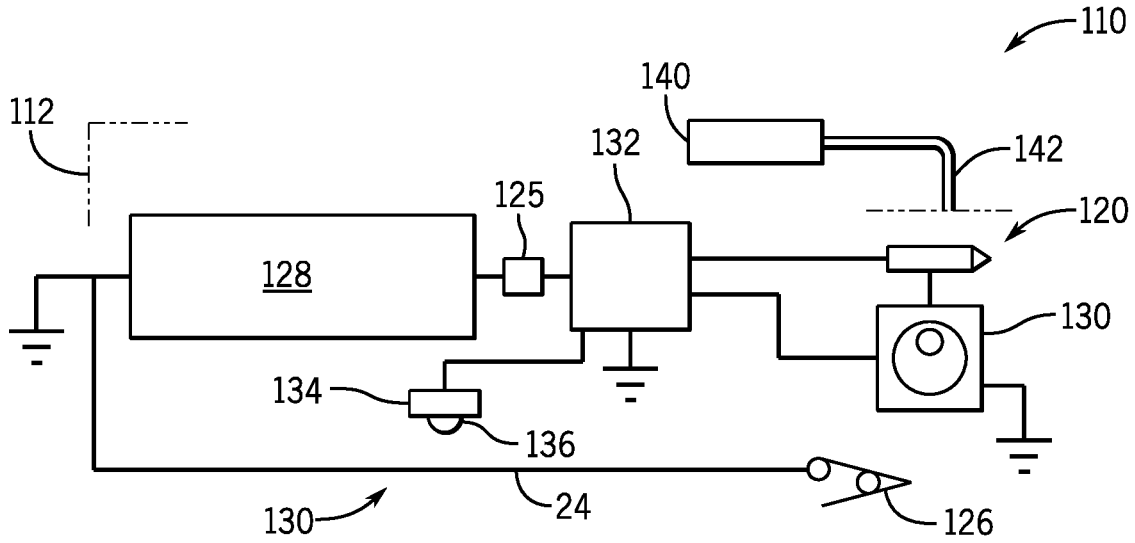
FIG. 8 is an electrical and fluid flow schematic showing interconnection of those components electrically and with respect to chemical fluid flow.

Referring now to FIGS. 7 and 8, the cylindrical body 112 may hold a battery pack 128 suitable for producing high-voltage, low-current anodizing power in a voltage range from 0 to 1160 V. This voltage may be produced through the use of high-voltage, low-current batteries or by means of a power converter contained in a controller 132, for example, employing a DC-to-DC converter and a more conventional battery such as lithium cells or zinc oxide cells. A ground side or negative terminal of the batteries 128 may connect directly to the grounding wire 124.

The controller 132 may provide for a microprocessor or microcontroller executing a stored program for control of the various components as will be described or may be implemented as discrete circuitry according to techniques well known in the art. In particular, the controller 132 may control a motor 130 that vibrates or rotates the tip 116 to provide an etching or cutting capability of that tip 116. The motor 130 may receive a lower voltage, for example, 112 V directly from the batteries 128 or through a buck type DC-to-DC converter when the batteries 128 are high-voltage batteries. For the purpose of etching, the tip 116 may be a hardened material such as a silicon carbide. The motor may be a vibration type motor having a winding periodically energized and deenergized by the controller 132 to draw a spring-biased armature plate attached to the tip 116 toward the winding and release the armature plate to vibrate the tip 116 or may be a permanent magnet type rotary motor for driving a burr or drill.

The controller 132 may also receive a control signal from a variable resistor 134 controllable with an externally extending operator 136 that may be operated by fingers of the user's hand 114 during use. Moving the operator 136 changes the voltage between the ground wire 124 and the tip 116. For this purpose, the controller 132 may control the DC-to-DC converter producing the high voltage from low-voltage batteries, or may chop the high voltage from high-voltage batteries, for example, using pulse width modulation according to techniques well known in the art.

Positioned to a side of the motor 130 within the cylindrical body 112, for example accessible through a hinged door or the like, is a chemical cartridge 140 which may, for example, be a sealed sleeve like a fountain pen cartridge holding anodizing chemicals. This cartridge 140 when installed will deliver liquid through a channel 142 to a collar 120 around the tip 116. This collar 120 and/or the tip 116 may be connected to the controller 132 to receive a high voltage therefrom.

Figure 9:
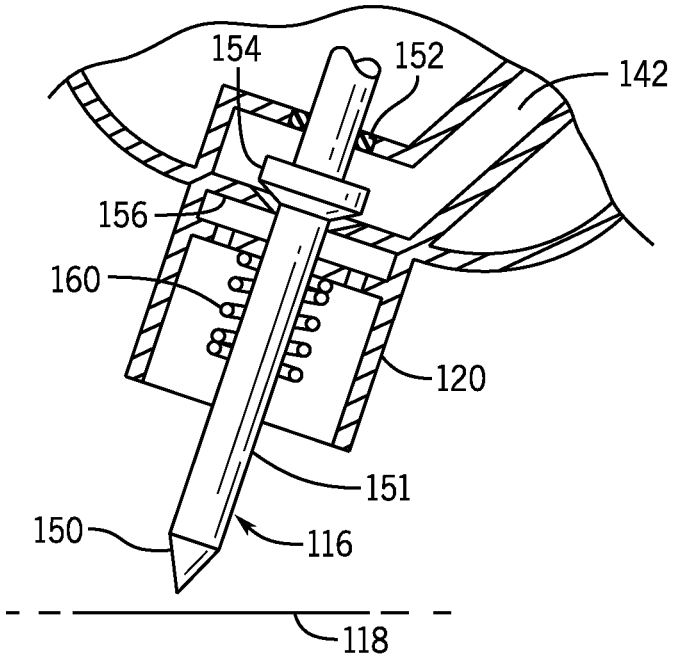
FIG. 9 is an elevational cross-section through the tip of the pen of FIG. 6 showing a metering valve for the anodizing chemicals.

Referring now to FIG. 9, the tip 116 may extend rearward from a sharpened conical point 150 as a tip shaft 151 through the collar 120 and then into and through the channel 142 to connect to the motor 130. A channel wall between the motor 130 and the channel 142 may include elastomeric seals 152, for example, an O-ring, to prevent leakage at the interface between the tip shaft 151 and the opening in that wall. Within the channel 142, the tip shaft 151 may connect to a valve seal 154 that seats against a valve seat 156, the latter between the channel 142 and the collar 120. The inter fitting of the valve seal 154 and the valve seat 156 prevents the flow of chemicals from the channel 142 (and thus from cartridge 140 shown in FIG. 10) when the valve seal 146 is seated against the valve seat 156. A biasing spring 160, for example, a helical compression spring surrounding a portion of the tip shaft 151 within the collar 120 may urge the tip shaft 151 and the tip 116 away from the collar 120 so as to provide this seal except when the tip shaft 151 is pressed against the workpiece 118. In this latter situation, the valve seal 154 moves away from the valve seat 156 allowing a controlled stream of anodizing chemicals to be delivered to the workpiece 118 in contact with the electrically conductive tip 116 and collar 120 to provide the anodizing action. Alternatively, the biasing spring 160 may be provided by a spring associated with the motor 130.

Figure 10:
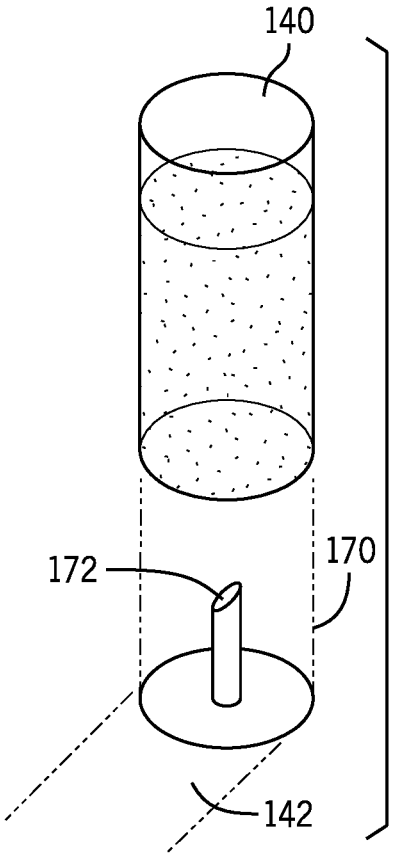
FIG. 10 is a fragmentary exploded view of a replaceable chemical cartridge usable with the pen of FIG. 1.

Referring now to FIG. 10, the cartridge 140 containing the anodizing chemicals may be installed within the pen 110 in a chamber 170 having a hollow spike 172 in the manner of a fountain pen that punctures the cartridge 140 when the cartridge 140 is installed to allow the chemicals to flow into the channel 142. The material of the cartridge 140 may be slightly elastic to seal against leaks around the spike 172 by the naturally compliant material of the cartridge 140.

Prior to use, the user may use the eraser 122 to clean the workpiece 118. Then the user may turn on the pen 110 by using the electrical switch 125 and then, by pressing the tip 116 against the workpiece 118, deliver a stream of chemicals to the workpiece 118. By controlling the voltage through operator 136, different color effects can be created and precisely applied. Alternatively, the pen 110 may be operated in the etching mode by turning on the motor 130 through a finger-operated pushbutton switch (not shown).

It will be appreciated that a similar structure may be used for plating of metals by an appropriate change in the chemicals in the cartridge 140 and a possible changing of the material of the tip 116.

Certain terminology is used herein for purposes of reference only, and thus is not intended to be limiting. For example, terms such as "upper," "lower," "above," and "below," refer to directions in the drawings to which reference is made. Terms such as "front," "back," "rear," "bottom," and "side," describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first," "second," and other such numerical terms referring to structures do not imply a sequence or order unless clearly indicated by the context. Although the stator and rotors are shown as disks in the disclosed embodiments, there is no requirement that the stator or rotor be in a disk form.

When introducing elements or features of the present disclosure and the exemplary embodiments, the articles "a," "an," "the," and "said," are intended to mean that there are one or more of such elements or features. The terms "comprising", "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties.

It is specifically intended that the present invention not be limited to the embodiments and illustrations contained herein and the claims should be understood to include modified forms of those embodiments including portions of the embodiments and combinations of elements of different embodiments as come within the scope of the following claims. All of the publications described herein, including patents and non-patent publications, are hereby incorporated herein by reference in their entireties To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What we claim is:

1. An anodizing pen for anodizing a metal surface and comprising:

a handheld housing extending along a housing axis between a first and second end, the handheld housing adapted to be supported by a user's fingers at a distal end during use with the first end extending distally from the user's fingers;

a self-contained reservoir holding an anodizing solution;

a metering valve providing multiple nonzero flow settings and positioned between the reservoir and the metering tip;

a metering tip extending from the first end and communicating through the metering valve with the reservoir to receive and release anodizing solution from the metering tip to the metal surface;

an electrical cable received by the handheld housing and providing a conductor in electrical communication with anodizing solution passing through the metering tip;

further including a user operable control controlling the electrical voltage received on the electrical cable and communicated to the anodizing solution;

wherein the user operable control provides signals to a remote power supply determining a voltage of the power supply from among multiple nonzero values and wherein the electrical cable conducts voltage from the power supply to the anodizing pen;

wherein the anodizing solution and the user operable control are adapted to apply an anodic oxide finish to a metal surface varying in color according to operator manipulation of the user operable control; and wherein the user operable control provides a control operator exposed through a wall of the handheld housing to be operable by a user hand while the user's hand is supporting the handheld housing;

wherein the metering tip is selected from the group consisting of:

(a) a porous brush providing a conduit between the metering valve and independent multiple filaments conducting anodizing solution there between (b) a porous stylus sharpened to a point and conducting anodizing solution therethrough (c) a spring-loaded ball adapted to release anodizing solution when pressed against the surface.

2. The anodizing pen of claim 1 wherein the user operable control includes a first and second button increasing or decreasing the electrical voltage, respectively, by a predetermined increment being a fraction of a maximum voltage.

3. The anodizing pen of claim 1 further including an electrical switch having an operator exposed through a wall of the handheld housing and positioned between the electrical cable and the anodizing solution to cease providing electrical power from the electrical cable to the anodizing solution when the operator is not activated by the user.

4. The anodizing pen of claim 3 wherein the electrical switch includes contacts within the handheld housing for disconnecting the electrical cable from the anodizing solution.

5. The anodizing pen of claim 1 further including a releasable tip connector at the first end adapted to releasably receive the metering tip and to communicate anodizing solution from the metering valve to the metering tip.

6. The anodizing pen of claim 1 wherein the metering valve provides a valve operator extending from the handheld housing to control an opening of the valve and flow of anodizing solution from the reservoir.

7. The anodizing pen of claim 1 further including a power supply receiving the electrical cable to provide electrical voltage to the electrical cable and providing a grounding cable for independent connection to a workpiece.

8. The anodizing pen of claim 7 wherein the power supply is adapted to receive signals from the electrical cable from the anodizing pen to control the voltage provided to the electrical cable.

9. The anodizing pen of claim 1 wherein the reservoir extends from within the handheld housing from the second end and provides a resealable opening through which the reservoir may be filled.

10. The anodizing pen of claim 1 wherein handheld housing is constructed of an electrically insulating material.

11. The anodizing pen of claim 1 wherein the handheld housing provides a radial projection at the second end receiving the electrical cable along an axis substantially parallel to an axis between the first and second end.

* * * * *